US006034648A

United States Patent [19]

Hope

[11] Patent Number: 6,034,648

[45] Date of Patent: Mar. 7, 2000

[54] BROAD BAND ANTENNA

[75] Inventor: Adam William Hope, Dalgety Bay, United Kingdom

[73] Assignee: Galtronics (UK) Limited, Edinburgh, United Kingdom

[21] Appl. No.: 09/043,899

[22] PCT Filed: Sep. 26, 1996

[86] PCT No.: PCT/GB96/02373

§ 371 Date: Mar. 27, 1998

§ 102(e) Date: Mar. 27, 1998

[87] PCT Pub. No.: WO97/12417

PCT Pub. Date: Apr. 3, 1997

[30] Foreign Application Priority Data

Sep. 28, 1995 [GB] United Kingdom ..... 9520018

[51] Int. Cl.[7] ..... H01Q 9/04

[52] U.S. Cl. ..... 343/790; 343/791; 343/792

[58] Field of Search ..... 343/790, 791, 343/792; H01Q 9/04

[56] References Cited

U.S. PATENT DOCUMENTS

| | | | |
|---|---|---|---|
| 3,945,013 | 3/1976 | Brunner et al. | 343/708 |
| 4,400,702 | 8/1983 | Tanaka | 343/790 |
| 4,658,260 | 4/1987 | Myer | 343/792 |
| 5,317,327 | 5/1994 | Piole | 343/790 |
| 5,473,336 | 12/1995 | Harman et al. | 343/790 |
| 5,565,880 | 10/1996 | Wang et al. | 343/790 |
| 5,604,506 | 2/1997 | Rodal | 343/790 |
| 5,668,564 | 9/1997 | Seward et al. | 343/790 |

FOREIGN PATENT DOCUMENTS

| | | |
|---|---|---|
| 0271685 A1 | 6/1988 | European Pat. Off. . |
| 0650215 A2 | 4/1995 | European Pat. Off. . |
| 2689688 A2 | 10/1993 | France . |
| 3826777 A1 | 2/1990 | Germany . |

*Primary Examiner*—Don Wong
*Assistant Examiner*—Hoang Nguyen
*Attorney, Agent, or Firm*—Lahive & Cockfield, LLP

[57] ABSTRACT

An antenna (1) comprises a first elongate antenna element (3) for connection, in use, to a signal carrying element of an apparatus with which the antenna is used, and a shorter second antenna element (5) extending substantially around a proximal end portion (9) of the first antenna element (3), a proximal end (6) of the second element (5) being connected to the proximal end (8) of the first element. A body (12) of a dielectric material is disposed between the first and second antenna elements (3,5). The antenna (1) has at least two optimum operating frequencies, each with an associated usable bandwidth, which bandwidths preferably overlap. The antenna (1) may include further antenna elements (20,22) which further extend the overall usable bandwidth ($B_u$) of the antenna (1). One or more "ground plane" elements (16,17) are preferably also provided in the antenna for decoupling the first and second antenna elements (3,5) from an earthed screen or element in the apparatus with which the antenna is used.

24 Claims, 4 Drawing Sheets

BROAD BAND ANTENNA

BACKGROUND OF THE INVENTION

This invention relates to antennae which are capable of being used for signal transmission and/or reception purposes at radio and microwave frequencies.

Antennae capable of operating in the radio and/or microwave frequency range are commonly attached to, or incorporated within, electrical equipment for use in the home, commercial or laboratory environments, such as televisions, radios, cellular telephones, and wireless local area networks (WLANS). One known type of antenna is the conventional "loop-type" antenna which essentially consists of a tuned loop of wire designed to receive or radiate signals at frequencies falling within a relatively narrow usable frequency bandwidth which may, typically, be approximately 50–60 MHz wide. Such antennae have the disadvantage of having directional radiation properties the effect of which is that the antenna needs careful orientational adjustment in order to operate effectively. Moreover, the antenna is incapable of receiving or radiating signals at frequencies falling outside its relatively narrow operational bandwidth.

Another known type of antenna is the "quarter wave" antenna which generally consists of an elongate antenna element whose length is chosen to be equal to one quarter of the wavelength at the desired optimum operating frequency of the antenna and which operates against an electrical ground which is usually provided by the earthed outer conducting element of a coaxial cable, the antenna element being connected to the central signal carrying element of the cable. Although such antennae have omni-directional radiation characteristics, they also have the disadvantage of operating effectively only over a fixed, relatively narrow frequency bandwidth. The antenna element of such quarter-wave antennae may often be telescopic such that the length of the element may be varied by a user. Such antennae still require careful adjustment by the user in order to operate at different frequencies which can be time consuming and frustrating for the user. Such variable length antennae are, moreover, unsuitable for use in, for example, local area networks and cellular radio communications applications where constant antenna adjustment is not a viable option for maintaining effective operation.

SUMMARY OF THE INVENTION

It is an object of the present invention to overcome one or more of the foregoing disadvantages and to provide an antenna having a relatively broad usable bandwidth and substantially omni-directional radiation characteristics.

According to the present invention, an antenna comprises a first elongate antenna element of fixed predetermined length, a proximal end of which is electrically connected, in use, to a signal carrying conducting element of an apparatus with which the antenna is used, and a second antenna element of fixed predetermined length, a proximal end of which is electrically connected to the proximal end of the first antenna element, the length of the second antenna element being substantially less than the length of the first antenna element and the second antenna element being formed and arranged so as to extend substantially around a proximal end portion of said first antenna element so as to substantially screen said proximal end portion, with the proximal end portion of the first antenna being supported by a body of dielectric material disposed between said first and second antenna elements, said proximal end portion of the first antenna element being electrically insulated from said second antenna element by said body of dielectric material.

One advantage of the antenna of the present invention is that it has two optimum operating frequencies (i.e. resonant frequencies), each with an associated usable bandwidth. This is due to the fact that in combination said first and second antenna elements operate together like a single quarter wave antenna having a total length equal to the distance from a distal end of the first element to the signal carrying conducting element of the apparatus with which the antenna is used, which length determines the resonant frequency of the combined antenna, and the second antenna element also operates as a quarter wave antenna whose length determines its own, different, resonant frequency. Moreover, like quarter wave antennae, the antenna of the present invention has substantially omni-directional radiation characteristics.

The term "usable bandwidth" is used herein and throughout this document to mean the frequency bandwidth over which the antenna return loss is sufficiently low to produce acceptable antenna performance where the antenna is used with commercially produced equipment. Conveniently the first antenna element simply consists of a length of low-loss conducting wire. Preferably the second antenna element is of generally tubular form. The usable bandwidth associated with the second antenna element on its own is greater that that associated with the first and second antenna elements combined, due to the relatively lower inherent Q-factor of the second antenna element on its own resulting from its generally tubular form.

Preferably, the length of the first and second antenna elements are such that the ranges of operating frequencies within the aforesaid usable bandwidths associated with the two elements overlap. In this manner an antenna having a relatively broad overall usable bandwidth is provided. In general, the ratio of the lengths of the first and second antenna elements may be from 4:1 to 4:3, for example about 3:2.

Advantageously, the body of the dielectric material which supports the portion of the first antenna element located within the generally cylindrical body of the second antenna element protrudes beyond a distal end of the second antenna element, part of the way towards a distal end of the first antenna element. The protruding length of dielectric material provides some impedance matching of electromagnetic (e.m.) signal waves along the length of the antenna, between a distal portion of the first antenna element (which has a relatively low e.m. wave impedance) and the distal end of the second antenna element (which has a relatively high e.m. wave impedance). This helps to produce improved antenna return-loss performance towards the lower frequency end of the usable bandwidth of the antenna. The dielectric material may be a polyethylene-type plastics material.

Advantageously, the antenna further comprises at least one "ground plane" element which is connected at a proximal end, in use of the antenna, to an electrically earthed (in radio frequency signal terms) screen or element provided in the apparatus with which the antenna is used. Preferably the ground plane element(s) extend(s) generally perpendicularly to the first and second antenna elements. The ground plane element(s) is/are formed and arranged so as to substantially decouple the first and second antenna elements from the earthed screen or element in the apparatus with which the antenna is used, at at least one or more operating frequency within the usable bandwidth of the antenna. In this way the ground plane element prevents radio frequency (RF) currents being induced in the aforementioned earthed screen element by the radiation field of the antenna (such currents could produce undesirable electrical interference or feed-back effects in the electrical equipment with which the antenna is used).

This may conveniently be achieved by providing at least two ground plane elements each in the form of a generally elongate element extending generally perpendicularly to the first and second antenna elements and at substantially one hundred and eighty degrees to each other and each connected, in use, at a respective proximal end to the electrically earthed screen or element of the apparatus within which the antenna is used. Preferably, the electrical length from a distal end of each ground plane element to the proximal end thereof is substantially equal to one quarter of the wavelength at a frequency which falls in a middle region of the usable bandwidth of the antenna. The two ground plane elements help provide a generally symmetrical spatial distribution of capacitance between the first and second antenna elements and electrical ground. Alternatively, a single ground plane element is provided in the form of solid disc of conducting material electrically connected at its centre to the electrically earthed screen or element of the apparatus with which the antenna is used, the diameter of the disc being substantially equal to one half of the wavelength at a frequency which falls in a middle region of the usable bandwidth of the antenna. Other forms of ground plane are also possible and may comprise, for example one or more helical conducting elements.

An outer surface of the generally cylindrical body of the second antenna element is preferably provided with a sleeve of insulating material. The antenna preferably also includes one or more further antenna elements which further extend the usable bandwidth of the antenna and/or improve antenna performance at its upper frequency range. Each of the further antenna elements may be in the form of a generally elongate conducting element, which is preferably a low-loss wire, which is electrically connected at a proximal end thereof to the proximal end of the first antenna element. Advantageously, each further element extends between the first element and the second element, from the latter's proximal end to its distal end. The presence of the extra wires within the hollow body of the second antenna element acts to produce increased efficiency of antenna operation in the usable bandwidth associated with the second antenna element. The further elements may each pass between the body of dielectric material and the inner surface of the second antenna element, or, preferably, they pass through the body of dielectric material itself, until they emerge at the distal end o the second antenna element. In a preferred embodiment, the body of dielectric material protrudes from the distal end of the second antenna element and the further antenna elements each pass through the generally tubular body of the second antenna element in the dielectric and emerge at a distal end of the protruding portion of dielectric. At the point where they emerge from the second antenna element, or the dielectric, the further elements are preferably returned towards the proximal end of the first and second antenna elements so as to lie substantially parallel to the outer surface of the second antenna element with electrically insulating material therebetween. The length of each of the further antenna elements is chosen to be such that the free end of each reaches back at least part of the way along the length of the second antenna element.

Where a plurality of further elements are provided they are advantageously each of a different predetermined length. The further element(s) each operate to provide a respective resonant frequency of the antenna, with a respective associated usable bandwidth. This is due to an open-circuit transmission line effect produced between each further antenna element and the second antenna element. The length of each further element from its free end to the point where it is level with the distal end of second antenna element determines the respective resonant frequency of the antenna. Certain lengths will cause the antenna to resonate at frequencies above the optimum operating frequency of the second antenna element. Some lengths may provide resonant frequencies below this frequency.

Preferably a plurality of such further antenna elements is provided and each of the elements is electrically connected to the first antenna element where they emerge from the distal end of the protruding portion of the dielectric material. This ensures that all the further elements and the first antenna element are held at the same e.m. wave RF potential at this connection which, in turn, ensures that the relative open-circuit transmission line effects produced by the further elements are not dependent upon the antenna's surrounding environment and/or spurious RF signals to which the further elements may be subjected.

In an alternative embodiment, the further antenna elements, which may conveniently each consist of a predetermined length of low-loss wire, have one end which is electrically connected to the first antenna element where it emerges from the dielectric material protruding from the second antenna element, the further element being positioned relatively parallel to the second antenna element with the free end of the further element reaching partly down it. This arrangement produces similar open-ended transmission line effects between each further element and the main body of the antenna comprising the first and second antenna elements.

The antenna of the present invention can thus provide an exceptionally broad usable bandwidth, for example, 200–1200 MHz, due to the combined plurality of resonant frequencies and associated bandwidths provided by the various antenna elements. The antenna has also been found to have good return-loss characteristics within its usable bandwidth, particularly where said further antenna elements are employed.

The second antenna element, protruding body of dielectric material, remaining unsupported portion of the first antenna element, and further antenna elements (if provided), may all be encased together in an insulating sleeve. The sleeve provides support and protection to the antenna elements. The ground plane elements are, preferably, also each encased in an insulating sleeve. A coaxial feed cable may be provided for use with the antenna for connecting the antenna to the apparatus with which it is to be used. Where such a feed cable is provided, the first antenna element is connected at its proximal end to a central signal carrying element of the feed cable and the ground plane element(s) are connected at their proximal end(s) to an outer screen element of the feed cable which element will, in RF signal terms, be electrically earthed, in use.

The relative lengths of the various antenna elements may be scaled up or down in order to provide an antenna for operating in a particular frequency range. Where lower frequencies are to be used (e.g. approximately 170 MHz, as used in communications application) and thus longer antenna element lengths are necessary, other forms of antenna element may be employed, such as helical elements, in order to retain a relatively compact overall antenna structure. For example, the generally cylindrical body of the second antenna element may comprise a coil of low-loss wire surrounding a portion of the first antenna element. The first antenna element may also include a helical portion, for example, towards the distal end of the element. Thus either or both of the first and second antenna elements could be partly or wholly helical.

Similarly, the antenna design could be scaled down in size for operation in higher frequency ranges e.g. up to 1.5 GHz for use in the microwave range, the upper frequency limit being restricted only by the geometric practicalities of implementation.

The antenna is thus suitable for use in many RF and microwave frequency applications including high-speed digital computer-to-computer data highways using RF-link technology, automatic interrogation of vehicles on motorways and, in particular, at toll booths, as well as more widespread application in television, radio reception and radio communication including cellular radio. References to RF signals hereinbefore should therefore be taken to include a reference to microwave signals. Preferred embodiments of the invention will now be described by way of example only and with reference to the accompanying drawings in which:

DESCRIPTION OF ILLUSTRATED EMBODIMENT

Figure 1:
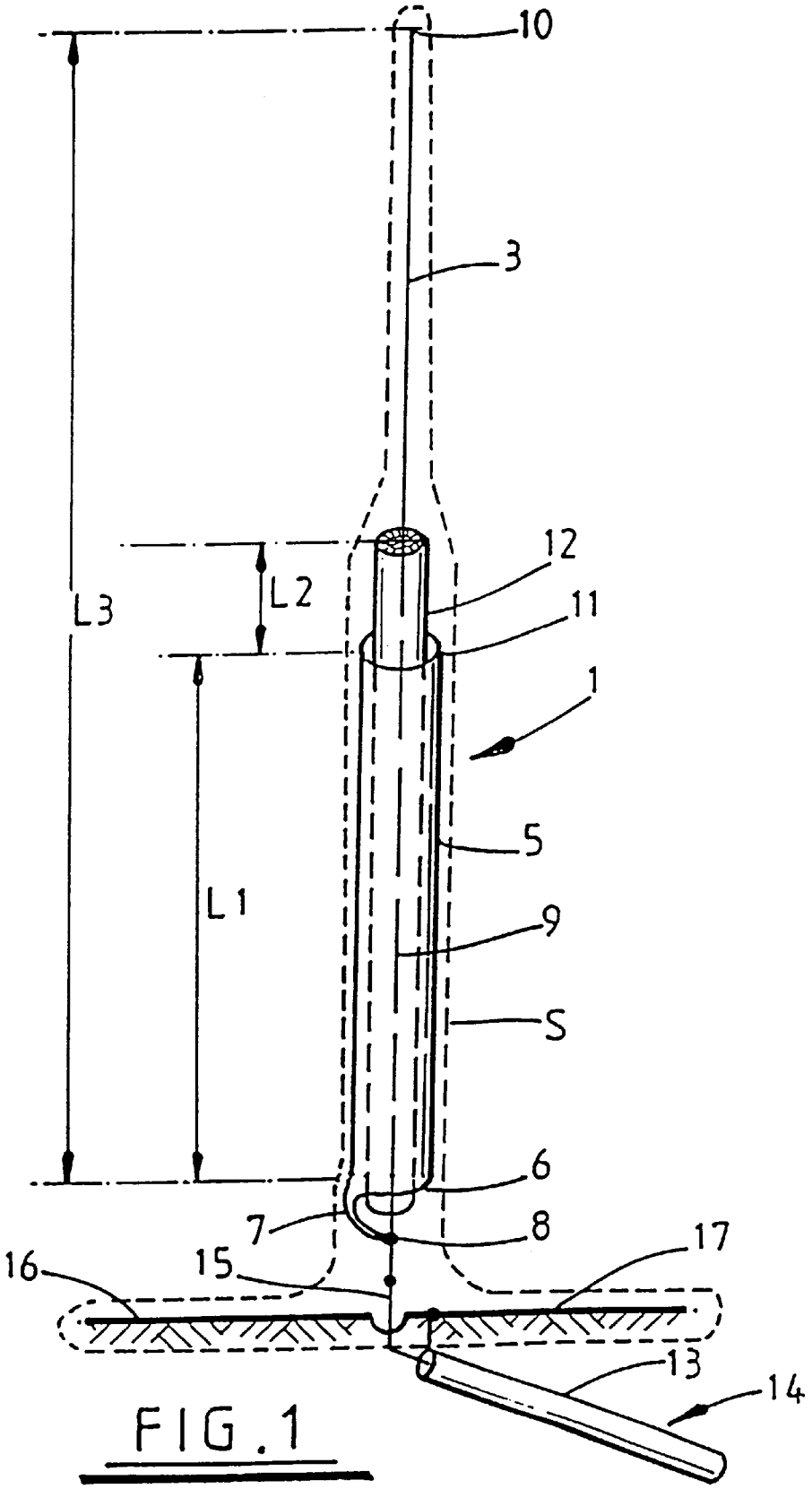
FIG. 1 is a schematic illustration of an antenna according to one embodiment of the present invention.

An antenna 1, shown schematically in FIG. 1 of the drawings, comprises a first elongate antenna element 3 which consists of a low loss electrically conductive wire, such as copper, and a second antenna element 5 which consists of a hollow generally cylindrical body of length L1 and made of copper braiding. At a proximal end 6 of the second antenna element 5 the copper braiding is "pig-tailed" to form a relatively thin, twisted end 7 which is electrically connected, for example by soldering, to a proximal end 8 of the first element 3. The generally cylindrical body of the second element 5 surrounds a proximal portion 9 of the first antenna element 3 and the length of the first antenna element from the proximal end 6 of the second antenna element to its distal end 10 is L3 which is substantially greater than L1.

A generally cylindrical body 12 of dielectric material is disposed between the first and second antenna elements 3, 5 and surrounds a portion of the first antenna element which includes the proximal portion 9 disposed within the generally cylindrical body of the second antenna element 5. The dielectric material used is a polyethylene plastics material commonly used as the dielectric material in conventional television (TV) coaxial cable. Other types of dielectric material could, however, be used. The length of the dielectric body 11 is longer than the length L1 of the generally cylindrical body of the second antenna element and is disposed within the second antenna element such that a portion of length L2 of the dielectric protrudes from a distal end 11 of the second antenna surrounding a corresponding length L2 of the first antenna element 3. The proximal end 8 of the first antenna element is electrically connected, in use of the antenna, to a conducting element 15 for carrying an electrical signal, which element may, for example, be the central wire of a coaxial feed cable 14 (as shown in FIG. 1), connected to, or incorporated in, the electrical apparatus (e.g. television, radio etc) with which the antenna 1 is used.

The antenna further includes two ground plane elements 16, 17 respective proximal ends of which are connected, in use to an electrically earthed (in RF signal terms) screen or element, which may as shown in FIG. 1 be the outer earth screen element 13 of a coaxial cable connected to, or incorporated within, the apparatus with which the antenna 1 is used.

The antenna operates, in use, according to the principle of a "quarter wave" antenna, the theory of which is that a signal carrying conducting element of length equal to one quarter of the wavelength of a predetermined (desired) optimum operating frequency of the antenna, operating against an associated earth or "ground plane", will behave like a conventional half-wave dipole antenna (due to the so called "mirror image" effects produced by the ground plane) and will resonate at the predetermined optimum operating frequency, this being the resonant frequency of the antenna.

In the antenna of FIG. 1 the complete antenna 1 has a first resonant frequency which is determined by the length of the complete antenna from the distal end 10 of the first antenna element 3 to the proximal end of the antenna where the first antenna element is connected to the conducting element 15. This first resonant frequency is equal to the signal frequency at which the total length of the complete antenna is approximately equal to one quarter of the signal wavelength; the actual resonant frequency may vary slightly from the theoretical value due to capacitance effects between antenna and ground and due to the fact that the antenna is not a single, perfect, continuous quarter wave antenna element. The first resonant frequency of the antenna has an associated usable bandwidth. The antenna 1 also has a second, higher, resonant frequency determined by the length L1 of the generally cylindrical body of the second antenna element 5 which is deliberately chosen to be substantially less than the length of the first antenna element, as shown in FIG. 1. The length from the distal end 11 of the second antenna element to the connection between the first and the conducting element 15 is similarly approximately equal to one quarter of the wavelength of the resonant frequency associated with the second antenna element. The usable bandwidth with this second resonant frequency of the antenna 1 is slightly broader than that associated with the first resonant frequency as the second antenna element behaves like a resonant circuit having an inherently lower Q-factor than that associated with the complete antenna including the first and second elements 3,5. This is primarily due to the second antenna element's predominantly hollow, cylindrical form.

In use, the generally cylindrical body of the second antenna element 5 substantially decouples the proximal portion 9 of the first antenna element 3 within the cylindrical body. The open end presented by the distal end 11 of the second element 5 presents a relatively high (e.m. wave) impedance to signals in the antenna, while the exposed, free portion of the first element 3 located beyond the protruding portion of the dielectric body 12 presents a relatively low impedance. The protruding portion of length L2 of the dielectric acts to provide some impedance matching which improves the overall performance of the antenna in the lower frequency range usable bandwidth associated with the full length of the antenna.

Figure 2A:
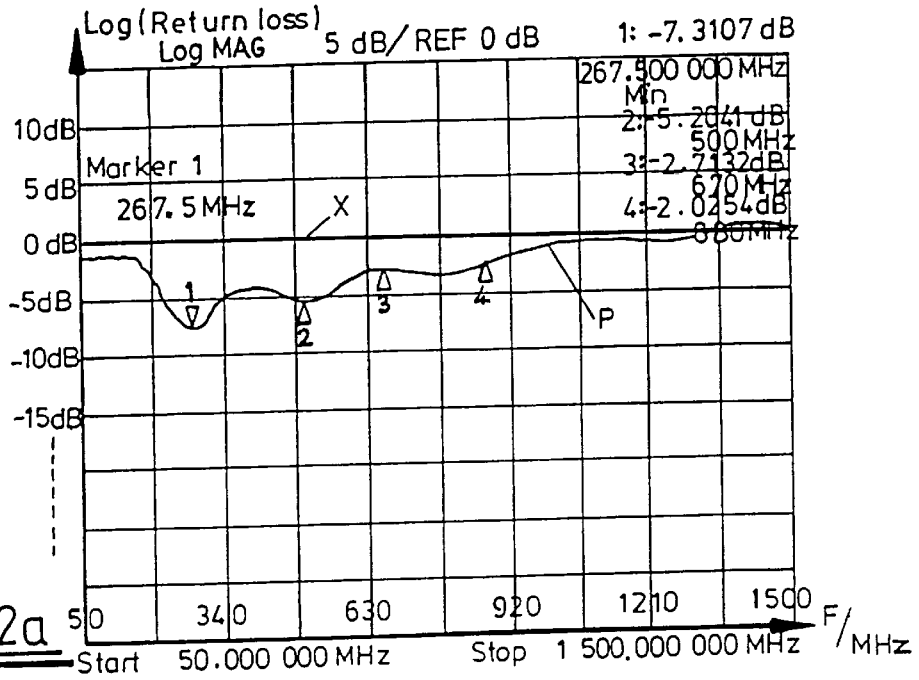
FIG. 2*a* is a logarithmic graph of signal return loss against frequency, for the antenna of FIG. 1.
Figure 2B:
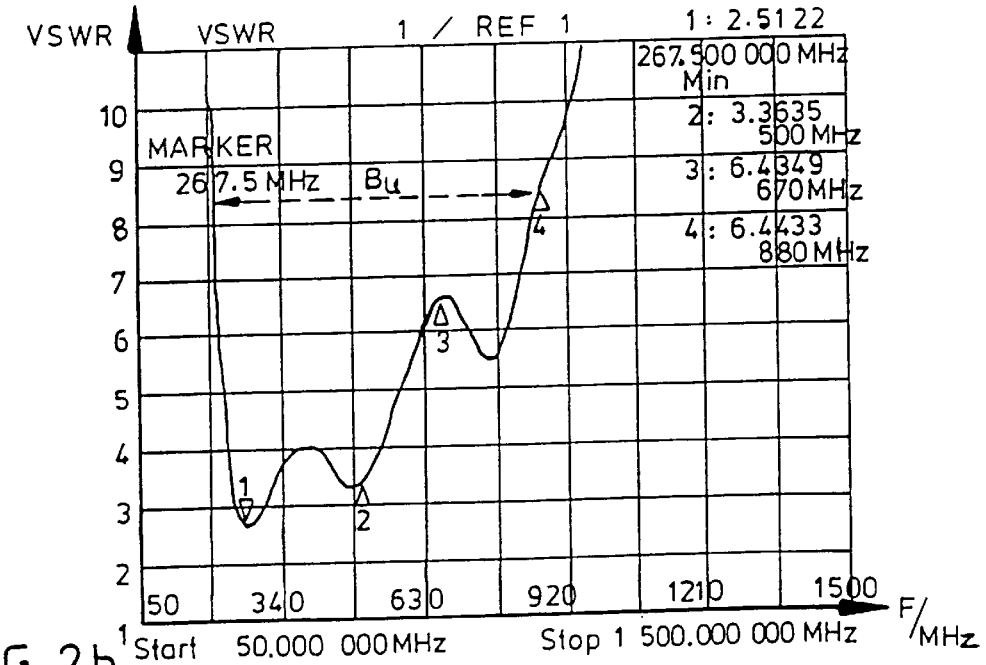
FIG. 2*b* is a graph of voltage standing wave ratio against frequency, for the antenna of FIG. 1.

The relative lengths of the two antenna elements 3, 5 are chosen such that the two usable bandwidths of the antenna partially overlap thus providing a relatively broad overall usable bandwidth. This is illustrated by FIGS. 2*a* and 2*b*. FIG. 2*a* is a logarithmically presented graph of antenna signal return loss (a measure of power loss due to current reflections occurring in the antenna), in decibels (dB), against signal frequency, F.

The usable bandwidth of the antenna extends largely over the region in which the plotted line P deviates substantially from the straight reference line X. FIG. 2*b* is a graph of the voltage standing wave ratio, VSWR (i.e. Maximum to minimum RF signal voltage measurable in the antenna) against signal frequency, F. The illustrated usable bandwidth $B_u$ of the antenna extends from approximately 250 MHz to 900 MHz. These graphs were obtained with antenna element lengths L1, L2, L3 approximately equal to 92, 30 and 255 millimeters respectively, and with ground plane elements 16, 17 each of length approximately 110 millimeters. The diameters of the first and second antenna elements 3, 5 are approximately 1.5 millimeters and 5 millimeters respectively and the diameter of the dielectric body 12 is approximately 4.2 millimeters.

The ground plane elements 16, 17 operate to decouple the first and second antenna elements 3, 5 from the earthed screen or element of the apparatus and/or feed cable to which the antenna is connected, thus preventing unwanted RF currents being induced therein (which could interfere with the operation of the apparatus itself). This may be substantially achieved by choosing the length of the ground plane elements such that they will resonate (in the same way as a quarter wave antenna element) when currents are induced therein at a frequency falling towards the middle region of the usable bandwidth $B_u$ of the antenna. In the antenna analyzed in FIGS. 2*a* and 2*b*, the lengths of the ground plane elements were 110 millimeters each. Alternative forms of ground plane are possible, such as helical elements or a flat metallic disc, the first and second antenna elements extending perpendicularly away from the centre of the helical elements or disc. Any number of ground plate elements may be used. By providing a symmetrical ground plane arrangement capacitances between the first and second antenna elements and ground are spatially symmetrically distributed, giving enhanced antenna performance.

To design an antenna 1 which will operate over a different frequency range i.e. the usable bandwidth is in a higher or lower frequency range, the relative lengths and sizes of the various antenna elements may simply be scaled up or down accordingly. Other forms of antenna element may also be used, for example, in lower frequency ranges where the required lengths of the first and second antenna elements are greater, helical elements may be used to retain a relatively compact antenna form. The second antenna element 5 could, for example, be a low-loss copper wire which is coiled into a cylindrical form surrounding the body of dielectric 12. In practice, it has been found that a piece of coaxial television cable may be adapted to provide the first and second antenna elements and thinner diameter pieces of coaxial cable can be used as the ground plane elements 16, 17.

Figure 4A:
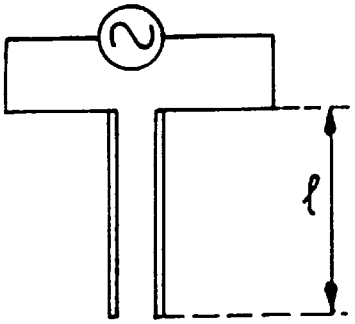
FIG. 4*a* is a schematric illustration of an open-circuited transmission line formed by elements of the antenna of FIG. 3.
Figure 4B:
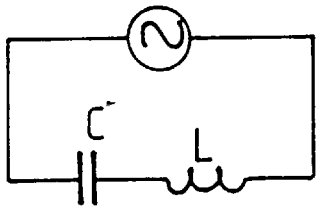
FIG. 4*b* is a circuit diagram of a series resonant circuit representing the open-circuited transmission line of FIG. 4*a;*
Figure 3:
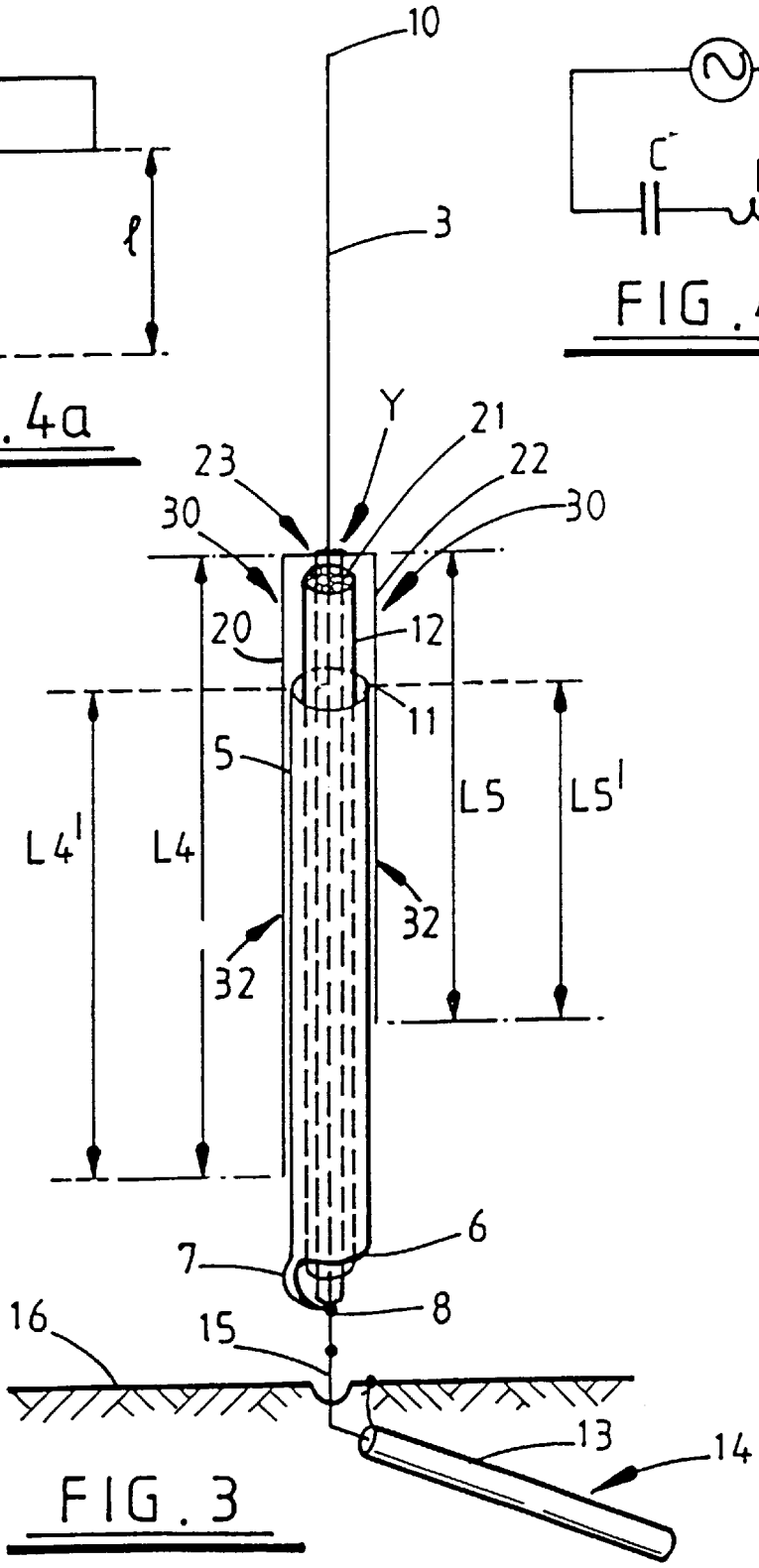
FIG. 3 is a schematic illustration of an antenna according to an other embodiment of the invention.

FIG. 3 shows schematically an improved embodiment of the invention. Like parts to those described with reference to FIG. 1 have been given identical reference numerals. The outer surface of the general cylindrical body of the second antenna element 5 is covered in an insulating sleeve (not shown). With the antenna element dimensions as given for the antenna analysed in FIGS. 2*a* and 2*b*, the diameter of the insulating sleeve is approximately 6.5 millimeters. In this embodiment the usable bandwidth has been further extended, and the performance of the antenna improved (i.e. in terms of efficiency), at the upper operating frequency range of antenna, by the addition of two further antenna elements 20, 22. The further elements each consist of a length of low-loss (e.g. copper) wire, a proximal end of which is electrically connected to the proximal end 8 of the first antenna element 3. The body of dielectric 12 contains cellular air spaces or channels 21 through respective ones of which each of the further elements (and the first element) are threaded from a distal end 23 from which they emerge into the surrounding air. The generally cylindrical body of the second antenna element 5 surrounds a portion of the body of dielectric 12, as in the embodiment of FIG. 1. Where the two further elements 20, 22 emerge from the dielectric 12 they are electrically shorted (e.g. by soldering) to the first antenna element 3 where it emerges from the dielectric (at a position Y along the length of the first antenna element). The remaining free distal portion of each of the further elements 20, 22 is bent back down the length L2 of the protruding portion of the dielectric and over the insulated sleeve of the second antenna element 5. The two further elements 20, 22 are of different lengths and each terminates part of the way down the length L1 of the second antenna element, the lengths of the elements between the point Y, and their respective free end being L4 and L5 respectively. At the point Y where the further elements are joined to the first element, all three elements are at the same signal RF potential (so relative effects due to environmental surroundings will not effect the relative RF potentials of the two further elements at the point Y). Viewed from this point and looking down the antenna towards the proximal ends 6, 9 of the first and second antenna elements, each of the lengths L4 and L5 i.e. the bent back portions or "stubs" of the further elements 20, 22, and the parallel portion of the main body of the antenna, present an open-circuited (open-ended) transmission line having a length l as shown in FIG. 4*a*. The length l is equal to the length of the respective stub between the distal end 11 of the second antenna element and the free end of the stub. For further elements 20, 22 the length l is equal to L4' for the longer element 20 and L5' for the shorter element 22, as shown in FIG. 3. The portion 30 of each transmission line disposed beyond the distal end 11 of the second antenna element 5, adjacent to the portion of the first antenna element 3, presents a relatively high impedance (largely from the inductance of that portion of the transmission line) and the portion 32 of the line disposed between the open-end of the transmission line and the distal end 11 of the second antenna element presents a relatively low impedance (largely due only to the capacitance between the stubs and the second antenna element 5). Each open-circuited transmission line may be represented by a series resonant circuit including a capacitor C and an inductor L, as shown in FIG. 4*b*. The total impedance of each of the two transmission lines is different due to the different stubs lengths L4, L5. The length L4', L5' of each stub between the distal end 11 of the second antenna element and the free end of that stub determines the capacitance between the stub and the second antenna element 5. The longer the length of the stub, the greater the capacitance.

Figure 5A:
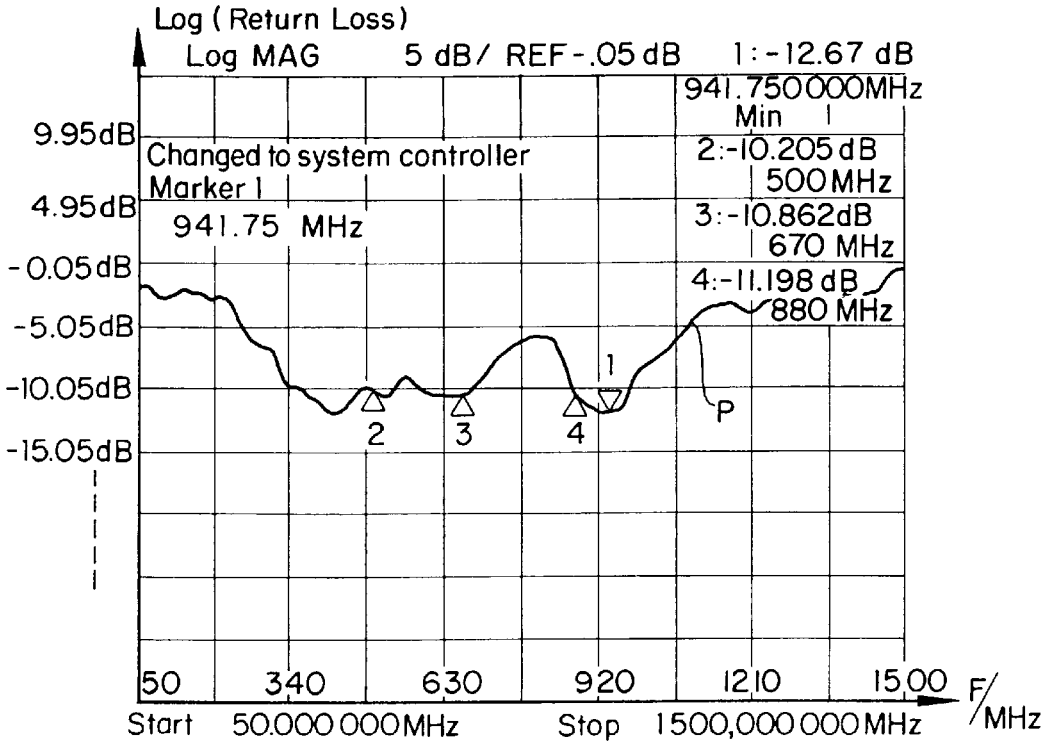
FIG. 5*a* is a logarithmic graph of signal return loss against frequency, for the antenna of FIG. 3.
Figure 5B:
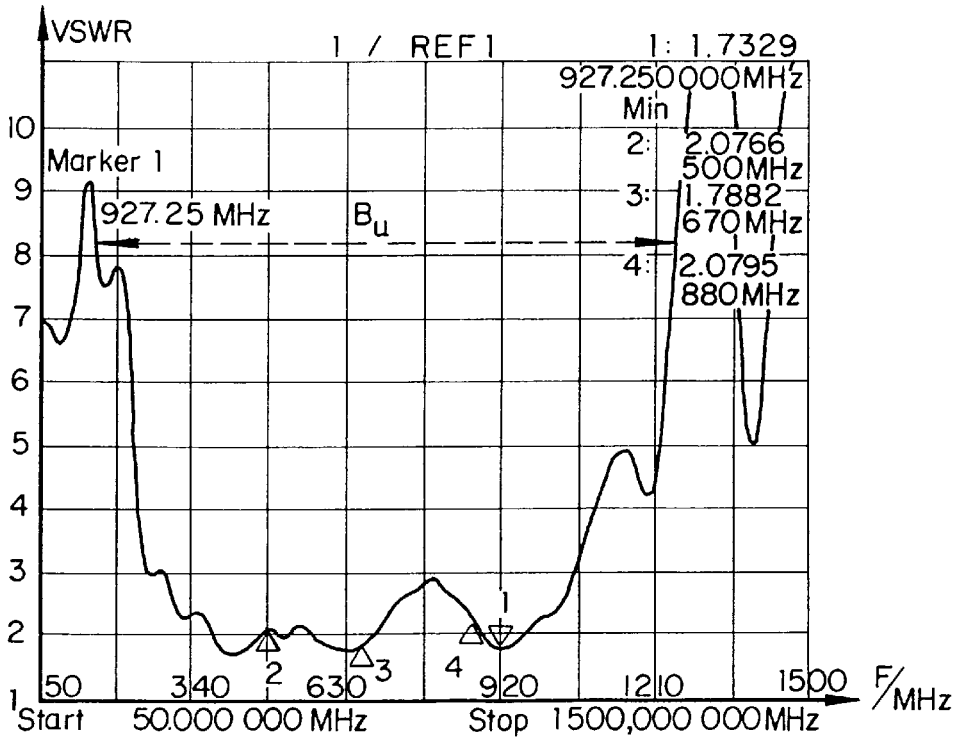
FIG. 5*b* is a graph of voltage standing wave ratio against frequency, for the antenna of FIG. 3.

The series resonant circuit represented by each open-circuited transmission line will resonate at a particular signal frequency when the reactances of the total inductance and capacitances of each circuit cancel out. This will be at a different frequency for each of the two transmission lines due to the different lengths L4', L5' of the stubs. In the antenna of FIG. 3 the resonant frequencies associated with the further elements 20, 22 will occur towards the upper frequency range of the usable bandwidth $B_u$ and so the further elements operate to further extend the usable bandwidth of the antenna 1. The shorter length element 22 has a higher associated resonant frequency than the longer length element 20. This is illustrated in FIGS. 5*a* and 5*b* which are logarithmically presented graphs of signal return loss against frequency, F, and signal voltage standing wave ratio, VSWR, against frequency, F, respectively. When compared with the graphs of FIGS. 2*a* and 2*b* (which are the same scale) it can be seen that the usable bandwidth $B_u$ of FIG. 5*b* is much greater than that of FIG. 2*b*. The stub lengths of the other elements 20, 22 were respectively L4=105 millimeters and L5=84 millimeters (the other antenna dimensions were the same in each analysis).

The usable bandwidth $B_u$ of the antenna extends from approximately 250 MHz to 1200 MHz in FIG. 5*b*, with relatively low signal volt age standing wave ratios (VSWR's) (unity being the ideal value) being achieved over a large proportion of this bandwidth. Similarly, the graph in FIG. 5*a* indicates improved signal return loss values as compared with the graph of FIG. 2*a*, the deeper troughs indicating increased antenna efficiency (i.e. less signal power loss due to current reflections).

Any number of further elements may be employed to broaden the usable bandwidth of the antenna, a practical limit being reached only when the stub lengths required to further extend the bandwidth become very short. (The shorter the stub length, the higher the associated resonant frequency of the antenna).

A relatively small-value fixed capacitance (not shown) may be connected between the proximal end of the first antenna element 3 and the ground plane elements 16, 17 to further optimise the antenna's signal return loss performance over the usable bandwidth of the antenna.

The first, second and further antenna elements may be encased in an insulating sleeve S (shown in broken line in FIG. 1) to provide support and protection to the antenna. The ground plane elements 16, 17 may be similarly encased, all the elements being held together by joining all the insulating sleeves together at their proximal ends to form a symmetrical, three forked antenna structure. The sleeve S may be conveniently made of PVC.

I claim:

1. A broad band antenna (1) comprising a first elongate antenna element (3) of a fixed predetermined length, a proximal end (8) of which is electrically connected, in use, to a signal carrying conducting element (15) of an apparatus with which the antenna (1) is used, and a second antenna element (5) of fixed predetermined length (L1), a proximal end (6) of which is connected to the proximal end (8) of the first antenna element (3) via a direct conductive pathway therebetween, said proximal end (6) of the second antenna element (5) thereby being electrically connected to said signal carrying conducting element (15), the length (L1) of the second antenna element being substantially less than the length of the first antenna element (3) and the second antenna element (5) being formed and arranged so as to extend substantially around a proximal end portion (9) of said first antenna element (3) so as to substantially screen said proximal end portion (9), with the proximal end portion of the first antenna element (3) being supported by a body (12) of dielectric material disposed between said first and second antenna elements (3,5), said proximal end portion (9) of the first antenna element being electrically insulated from said second antenna element (5) by said body (12) of dielectric material, wherein the antenna has two optimum operating frequencies which are dependent upon the lengths of said first and second antenna elements, each said optimum operating frequency having an associated usable bandwidth, and wherein said predetermined lengths of said first and second antenna elements are such that said associated usable bandwidths together form a continuous usable bandwidth ($B_u$) of the antenna.

2. An antenna according to claim 1 wherein the first elongate antenna element (3) comprises a length of conducting wire.

3. An antenna according to claim 1 wherein the second antenna element (5) is of generally tubular form.

4. An antenna according to claim 1, wherein said predetermined lengths of the first and second antenna elements (3,5) are such that there are overlapping ranges of operating frequencies within said usable bandwidths associated with said two optimum operating frequencies of the antenna.

5. An antenna according to claim 1 wherein the ratio of the predetermined lengths of said first and second antenna elements (3,5) is from 4:1 to 4:3.

6. An antenna according to claim 5 wherein said ratio is approximately 3:2.

7. An antenna according to claim 1 wherein the body (12) of dielectric material protrudes beyond a distal end (11) of the second antenna element (5).

8. An antenna according to claim 1 wherein the dielectric material of said body (12) is polyethylene.

9. An antenna according to claim 1, further comprising at least one ground plane element (16) formed and arranged for connection, in use the antenna (1), to an electrically earthed element (13) of the apparatus with which the antenna is used.

10. An antenna according to claim 9 wherein said one or more ground plane elements (16) are elongate and extend substantially orthogonally to the first and second antenna elements (3,5).

11. An antenna according to claim 9 further comprising two elongate ground plane elements (16,17) extending substantially orthogonally to the first and second antenna elements (3,5) and at substantially one hundred and eighty degrees to each other.

12. An antenna according to claim 11 wherein the electrical length of each of the said two elongate ground plane elements (16,17) is substantially equal to one quarter of the wavelength at a frequency which falls in a middle region of said usable bandwidth ($B_u$) of the antenna (1).

13. An antenna according to claim 9 wherein a single ground plane element is provided in the form of a generally planar element of electrically conducting material extending in a radial manner from, and substantially perpendicularly to, said first elongate antenna element (3) and formed and arranged for connection substantially at its centre, in use of the antenna (1), to an electrically earthed element (13) of the apparatus with which the antenna is used.

14. An antenna according to claim 13 wherein said single ground plane element is in the form of a disc having a diameter substantially equal to one half of the wavelength at a frequency which falls in a middle region of said usable bandwidth ($B_u$) of the antenna.

15. An antenna according to claim 9, wherein the ground plane element is encased in a respective insulating sleeve.

16. An antenna according to claim 1, further comprising one or more additional antenna elements (20,22) which extend said usable bandwidth ($B_u$) of the antenna (1).

17. An antenna according to claim 16 wherein at least one of said additional antenna elements (20,22) is an elongate conducting element which is electrically connected at a proximal end thereof to the proximal end (8) of the first antenna element (3).

18. An antenna according to claim 17, wherein a plurality of such additional elongate antenna elements (20,22) are provided and each additional antenna element (20,22) is of a different predetermined length.

19. An antenna according to claim 16 wherein an outer surface of the generally cylindrical body of the second antenna element (5) is provided with a sleeve of insulating material.

20. An antenna according to claim 19, wherein at least one of said additional antenna elements passes through the body (12) of dielectric material, emerging at a distal end (23) of a portion thereof which portion protrudes beyond a distal end (11) of the second antenna element (5), from where said additional antenna element (20,22) returns towards the proximal ends (8,6) of the first and second antenna elements (3,5) so as to lie substantially parallel to an outer surface of the second antenna element (5) with said sleeve of insulating material therebetween, a free end of said additional antenna element reaching back at least a part of the way along the length (L1) of the second antenna element (5).

21. An antenna according to claim 20 wherein a plurality of such additional elongate antenna elements (20,22) are provided and each of said additional antenna elements (20,22) is electrically connected to the first antenna element (3) where said additional antenna element emerges from the distal end (23) of said protruding portion of the dielectric body (12).

22. An antenna according to claim 1, wherein said first and second antenna elements (3,5) are together encased in an insulating sleeve (S).

23. An antenna according to claim 22, wherein the insulating sleeve (S) is made of polyvinylchloride.

24. An antenna according to claim 1, wherein the second antenna element (5) comprises a hollow, generally cylindrical body made of copper braiding.

* * * * *